US007237300B2

(12) United States Patent
Tomasiak et al.

(10) Patent No.: US 7,237,300 B2
(45) Date of Patent: Jul. 3, 2007

(54) MULTI-STEPPED APPLIANCE ACCESSORY HOLDER

(75) Inventors: Mark J Tomasiak, O'Fallon, MO (US); Michael F Martin, Florissant, MO (US); Stuart V Holsten, O'Fallon, MO (US)

(73) Assignee: Emerson Electric Co., St Louis, MO (US)

( * ) Notice: Subject to any disclaimer, the term of this patent is extended or adjusted under 35 U.S.C. 154(b) by 0 days.

(21) Appl. No.: 10/249,348

(22) Filed: Apr. 2, 2003

(65) Prior Publication Data

US 2004/0124199 A1 Jul. 1, 2004

Related U.S. Application Data

(60) Provisional application No. 60/319,815, filed on Dec. 27, 2002.

(51) Int. Cl.
*A47L 5/00* (2006.01)

(52) U.S. Cl. ..... 15/323; 15/353

(58) Field of Classification Search ..... 15/323, 15/353

See application file for complete search history.

(56) References Cited

U.S. PATENT DOCUMENTS

| | | | | |
|---|---|---|---|---|
| 3,085,279 | A * | 4/1963 | Meyerhoefer | 15/323 |
| 3,721,071 | A * | 3/1973 | Mueller et al. | 55/360 |
| 3,869,265 | A * | 3/1975 | Wolter et al. | 15/327.2 |
| 5,373,606 | A * | 12/1994 | Bosyj et al. | 15/323 |
| 5,528,794 | A * | 6/1996 | Tomasiak | 15/323 |
| 5,608,945 | A * | 3/1997 | Crouser et al. | 15/328 |
| 5,924,165 | A * | 7/1999 | Gierer et al. | 15/323 |
| 5,943,731 | A * | 8/1999 | Wood | 15/323 |
| 6,237,187 | B1 * | 5/2001 | Hult et al. | 15/323 |
| D447,609 | S | 9/2001 | Hult et al. | |
| 2002/0124345 | A1 * | 9/2002 | Holsten et al. | 15/353 |
| 2002/0138937 | A1 * | 10/2002 | Griffin et al. | 15/323 |
| 2004/0098822 | A1 * | 5/2004 | Martinez et al. | 15/323 |

* cited by examiner

*Primary Examiner*—Terrence R. Till
(74) *Attorney, Agent, or Firm*—Locke Liddell & Sapp LLP

(57) ABSTRACT

The present invention provides a multi-stepped accessory holder for an appliance having accessories that have dissimilar inner diameter connections, such as accessories with a male and/or a female ends. The female end of an accessory has a first inner diameter, and the male end of an accessory has a second inner diameter. The accessory holder includes a base having a first perimeter, and an upper portion mounted atop the base that has a second perimeter. The second perimeter of the upper portion is smaller than the first perimeter of the base. When the female end of an accessory is placed upon the accessory holder, the female end engages the first perimeter of the base. If it is desired that an accessory's male end be placed upon the holder, the male end engages the second perimeter of the accessory holder's upper portion.

3 Claims, 14 Drawing Sheets

MULTI-STEPPED APPLIANCE ACCESSORY HOLDER

CROSS REFERENCE TO RELATED APPLICATIONS

This application claims priority to U.S. Provisional Application No. 60/319,815, filed Dec. 27, 2002 and having the same inventors and title as the present application, which is incorporated by reference herein.

BACKGROUND OF INVENTION

The present invention relates generally to an accessory holder for holding or storing the accessories of an appliance, and more particularly to an accessory holder for holding the accessories of a wet/dry vacuum.

Appliances, such as wet/dry vacuums may include holders for storing accessories, such as brushes, crevice tools, extension wands, hoses, end fitting, etc. Because typical accessories of a wet/dry vacuum are normally connected by inserting one end of the accessory into the open end of another wet/dry vacuum accessory, or by inserting one end of the accessory into a connection of the wet/dry vacuum itself, the accessories of a wet/dry vacuum typically have both a male and a female end. Although the typical wet/dry vacuum accessory has both a male and a female end, the accessory holders are normally designed to accept only the male or female end of the appliance. Normally, tapered friction fits on a plug on the wet/dry vacuum are used to create a holder for the accessory. For example, a wand accessory having a female end with a large inner diameter is forced upon the tapered plug style accessory holder, so that the wand engages the tapered plug in order to secure the wand on the holder.

A user's determination of which end of the accessory is capable of being inserted onto a holder is usually determined by trial and error; resulting in the user having to switch between the respective ends of the accessory before the user can place the accessory onto the holder. Moreover, in order to accommodate accessories that may have male or female connections at both ends, different accessory holders designed to hold only those specific accessories are sometimes incorporated into the appliance.

The present invention is directed to overcoming, or at least reducing the effects of, one or more of the problems set forth above.

SUMMARY OF INVENTION

In one embodiment, among others, the present invention provides a holder for holding accessories of an appliance. The accessories have a first inner diameter connection and/or a second inner diameter connection, with the first inner diameter connection being larger than the second inner diameter connection. For example, the first inner diameter connection can be the female end of an accessory and the second inner diameter connection can be the male end of an accessory. The holder includes a first member that has a first perimeter and a second member that has a second perimeter that is smaller than the first perimeter. When the first inner diameter connection of an accessory is placed upon the accessory holder, the first inner diameter connection engages the first perimeter of the first member; and when the second inner diameter connection of an accessory is placed upon the accessory holder, the second inner diameter connection engages the second perimeter of the second member. Thus, the accessory holder is capable of holding either end of a single appliance accessory that has dissimilar end connections, and/or is capable of holding multiple appliance accessories that have dissimilar end connections.

In a further aspect of an embodiment of the present invention, the first member has a first projection and the second member that has a second projection, with the first projection being located at a distance below the second projection. In this embodiment, the first perimeter includes that portion of the first perimeter formed by the first projection and the second perimeter includes that portion of the second perimeter formed by the second projection. As previously mentioned, the second perimeter is smaller than the first perimeter. In this aspect of this embodiment, when the first inner diameter connection of an accessory is placed upon the accessory holder, the first inner diameter connection engages the first projection; and when the second inner diameter connection of an accessory is placed upon the accessory holder, the second inner diameter connection engages the second projection.

In a further aspect an embodiment of the present invention, the first member is a base, and the second member is an upper portion that is mounted atop the base. In this aspect, a shoulder can be formed by the base and upper portion so that when the second inner diameter connection of an accessory engages the second projection the second accessory sets atop the shoulder. In still a further aspect, a top surface of the upper portion has a slope or is flush with any surrounding surface, such as the lid of the appliance. In still a further aspect, the base and upper portion are integral.

In yet another aspect of an embodiment of the present invention, the accessory holder's first projection is located directly below the second projection. In still other aspects of embodiments of the present invention, the holder's first and/or second projections are surface type projections or lobe projections.

In further embodiments of the present invention, the accessory holder has a plurality of first projections and a plurality of second projections. In a further aspect of this embodiment, the spacing between the plurality of first projections is equidistant and/or the spacing between the plurality of second projections is equidistant. Alternatively, in yet another aspect of this embodiment, the first and/or second projections are oriented so that removal or insertion of the accessory is complemented in relation to the accessory holder's location relative to the appliance, the accessories, or a component of the appliance.

In yet another embodiment of the present invention, the accessory holder has at least two members that each have a lower step and an upper step mounted atop the lower step. In this embodiment the lower step forms a first perimeter and the upper step forms a second perimeter, the first perimeter being larger than the second perimeter. The post members are positioned within the holder so that when an accessory's first inner diameter connection, such as the female end of an accessory, is placed upon the holder, the first inner diameter connection engages the lower step of each post member, and when an accessory's second inner diameter connection, such as the male end of an accessory, is placed upon the holder, the second inner diameter connection engages the upper step of each post member.

The foregoing summary is not intended to summarize each potential embodiment or every aspect of the invention disclosed herein, but merely to summarize some aspects of the present invention.

BRIEF DESCRIPTION OF DRAWINGS

The foregoing summary, various embodiments, and other aspects of the present invention will be best understood with reference to a detailed description of specific embodiments of the invention, which follows, when read in conjunction with the accompanying drawings, in which.

Figure 1:
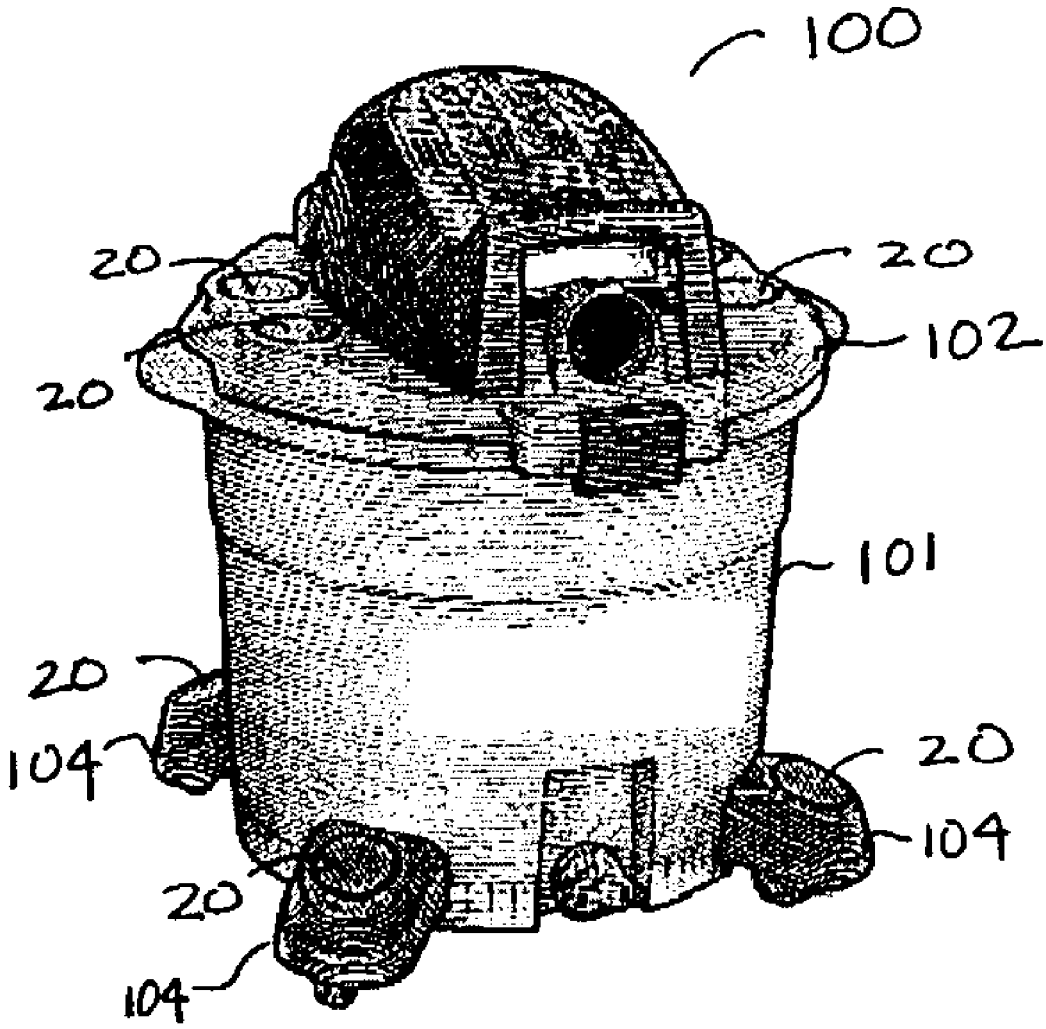
FIG. 1 illustrates a wet/dry vacuum having an embodiment of an accessory holder of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual implementation, numerous implementation—specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1, an appliance 100 is illustrated having an embodiment of an accessory holder 20 in accordance with the present invention. In FIG. 1, a front view of appliance 100 having accessory holders 20 is shown. FIGS. 1A, 1B, 1C, and 1D illustrate various top views of the top surface of appliances 100 having accessory holders 20.

Figure 1A:
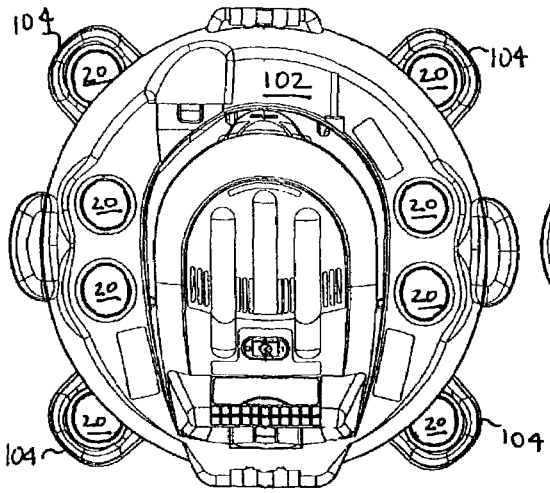
FIGS. 1A through 1D are various top views of a wet/dry vacuum incorporating an embodiment of an accessory holder of the present invention.
Figure 1B:
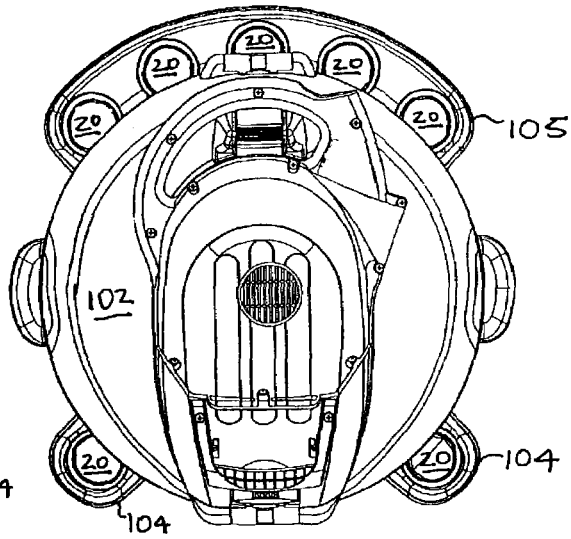
Figure 1C:
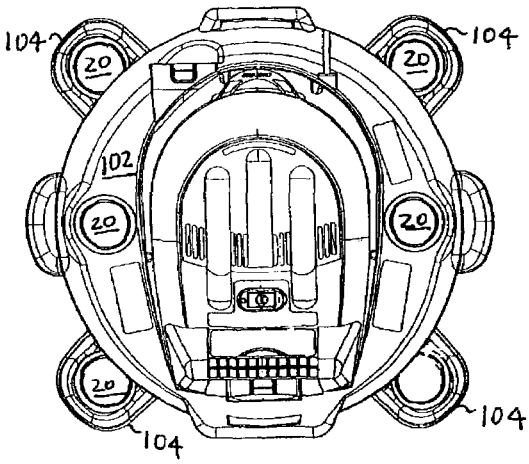
Figure 1D:
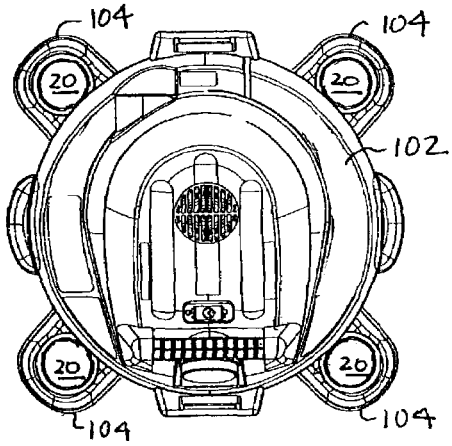

In FIGS. 1 and 1A 1D, the accessory holder 20 is illustrated on a wet/dry vacuum appliance 100. However, embodiments of the accessory holder of the present invention can be used on any appliance having accessories in which at least one of the accessories has a dissimilar inner diameter connection than another accessory's inner diameter connection. For example, the accessory holder can be used on a wet/dry vacuum in which the female end of a wand accessory has a larger first inner diameter than a second inner diameter of the male end of a hose accessory for the wet/dry vacuum. Moreover, embodiments of the accessory holder of the present invention can be used on any appliance having accessories in which at least one of the accessories itself has dissimilar inner diameter connections. For example, the accessory holder can be used on a wet/dry vacuum in which the female end a wand accessory had a larger first inner diameter than a third inner diameter of the male end of that same wand accessory. In one embodiment of the present invention the accessory holder is multi-stepped and designed so that any accessory can be connected to the accessory holder, whether it is the male or female end of the accessory. Accessory holder 20 has a lower step that accepts the larger female end of an accessory, and has an upper step that accepts the smaller male end of an accessory.

Figure 8:
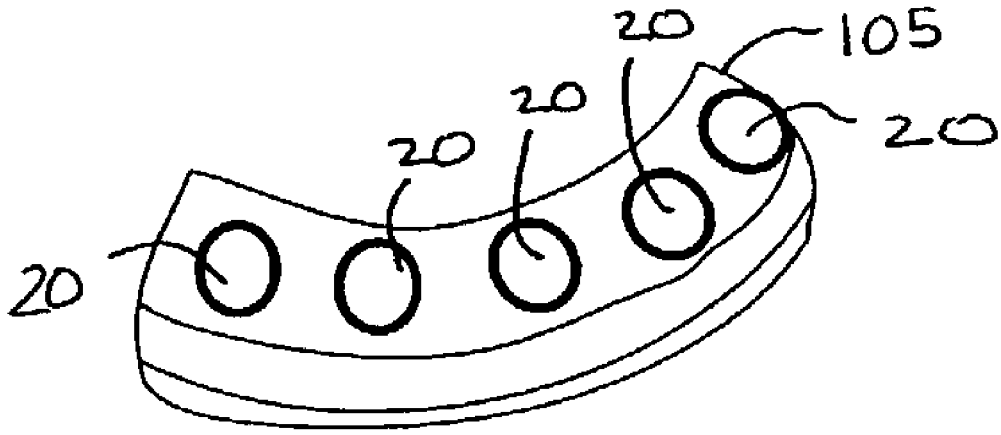
FIG. 8 illustrates a caddy storage accessory having an embodiment of an accessory holder of the present invention mounted within the caddy storage accessory.

As illustrated in FIGS. 1 and 1A 1D, the accessory holder 20 is shown on a wet/dry vacuum appliance 100. Referring to FIG. 1, the vacuum 100 includes a drum 101, a plurality of caster feet 104 coupled to the drum 101, and a top surface having a lid 102 mounted atop the drum 101 and a motor portion 103 coupled to the lid 102. As shown in FIGS. 1 and 1A 1D, an embodiment of accessory holder 20 is located in the caster feet 104, the lid 102, and a caddy storage accessory 105. This multi-step accessory holder 20 can be utilized in any suitable area of the appliance. For example, when used on a wet/dry vacuum, the accessory holder 20 can be located on caster feet, the power head, the lid, the motor cover, or a caddy. A perspective view of the caddy storage accessory 105 is also illustrated in FIG. 8. Although accessory holder 20, as illustrated in FIGS. 1, 1A 1D and 8, is shown substantially flush with caster feet 104, lid 102, and caddy storage accessory 105, accessory holder 20 can also be mounted in a non-flush, raised manner. When the accessory holder 20 is mounted in a flush manner or at least partially within the caster feet 104, lid 102, and caddy storage accessory 105, the sides of caster feet 104, lid 102, and caddy storage accessory 105 serve as an outer shell that forms a wall around accessory holder 20 leaving adequate space between the perimeter of accessory holder 20 and the wall formed by the sides of caster feet 104, lid 102, or caddy storage accessory 105 to house the accessory.

Figure 2:
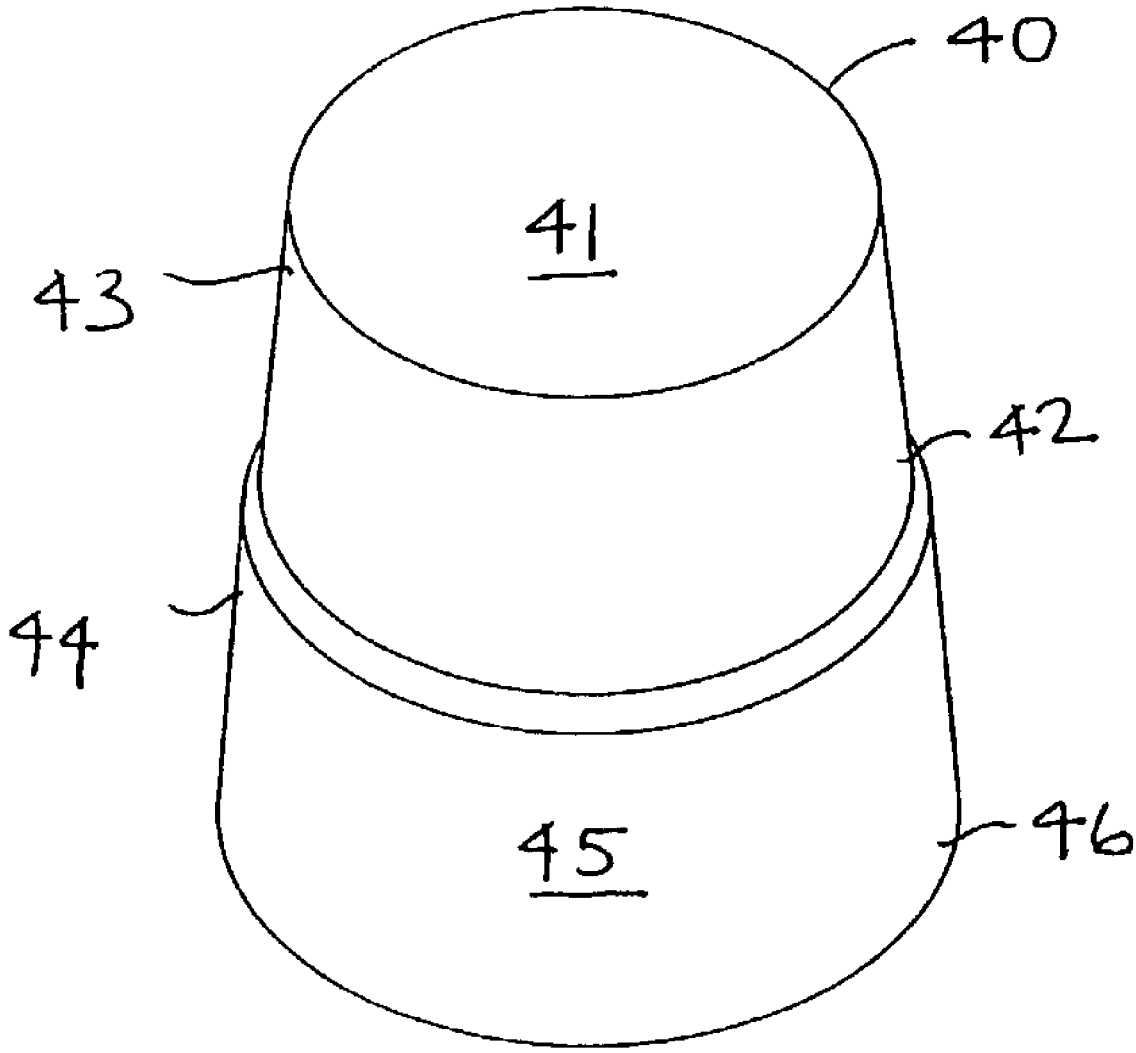
FIG. 2 illustrates a side view of an embodiment of an accessory holder of the present invention.

An example of an accessory holder in accordance with one embodiment of the present invention is illustrated in FIG. 2. As shown in FIG. 2, accessory holder 40 includes a first member that is a base 45 and includes a second member that is an upper portion 41. As illustrated in FIG. 2, the upper portion 41 sets atop base 45. The upper portion 41 has a first end 43 and a second end 42. The upper portion's first end 43 is tapered, and as can be seen in FIG. 2, the second end 42 has a larger perimeter that the tapered first end 43. Similarly, the base 45 also has a tapered first end 44 and a larger perimeter second end 46.

Figure 4:
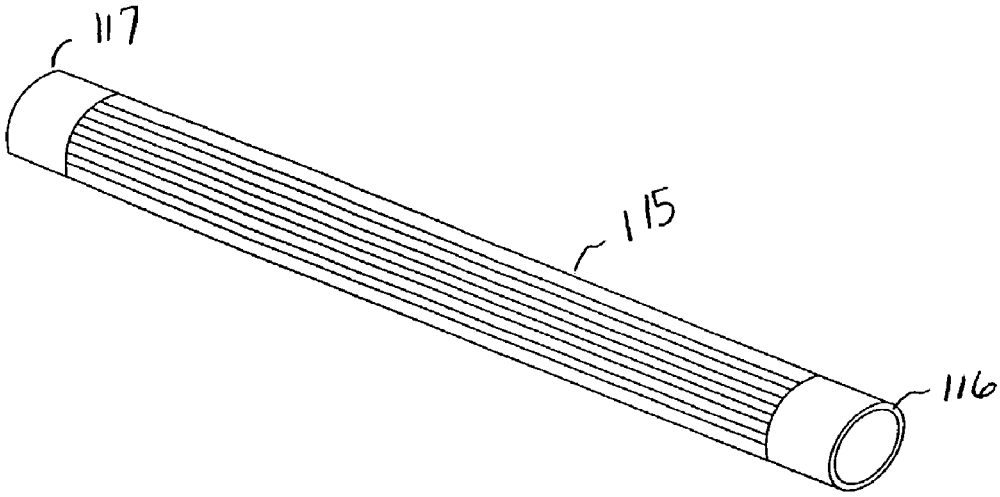
FIG. 4 illustrates a wand accessory.
Figure 5:
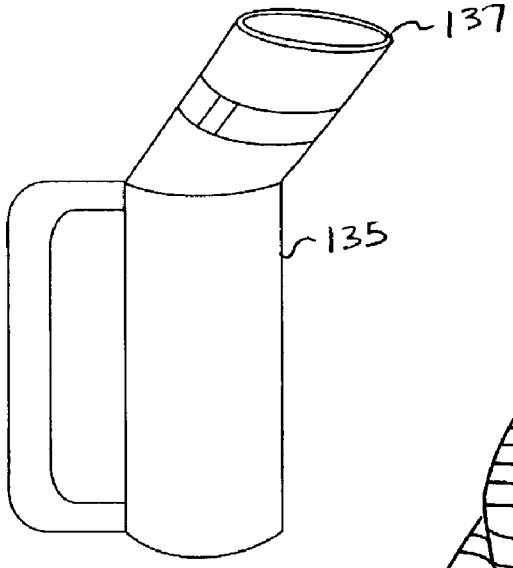
FIG. 5 illustrates a hose holder accessory.
Figure 6:
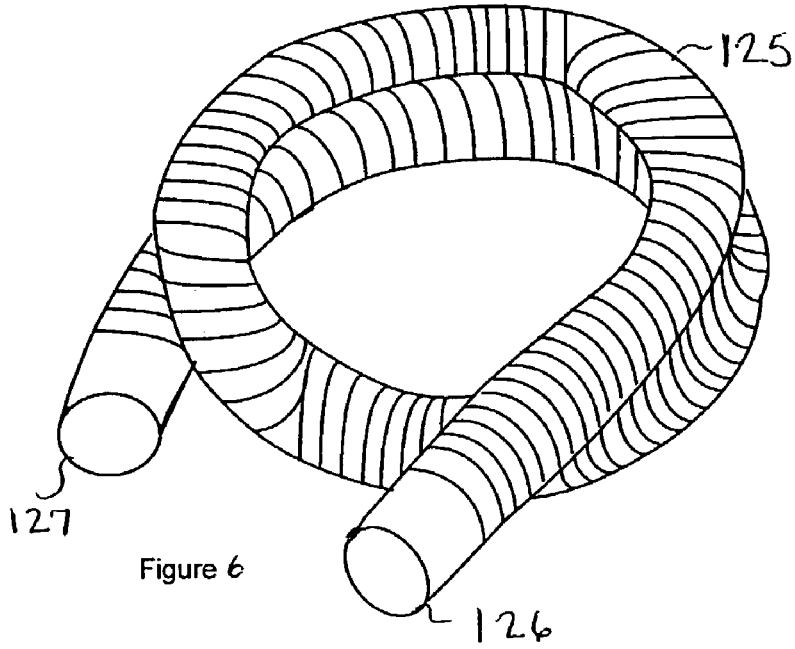
FIG. 6 illustrates a hose accessory.

Accessory holder 40 is designed to hold both the male and female end of appliance accessories. Examples of some wet/dry vacuum accessories are shown in FIGS. 4 6. FIG. 4 illustrates a wand 115 having a female end 116 and a male end 117. Female end 116 of wand 115 has a female inner diameter connection and male end 117 of wand 115 has a male inner diameter connection, wherein the female inner diameter is larger than the male inner diameter. FIG. 6 illustrates a hose 125. Hose 125 has two male ends 127 having a male inner diameter connection. Because wand 115 and hose 125 can often be cumbersome to hold, a hose holder 135, as illustrated in FIG. 5, is sometimes used. Hose holder 135 has a male end 137 having a male inner diameter connection and a female end 138 having a female inner diameter connection. Male end 137 of hose holder 135 is adapted to engage female end 116 of wand 115, and female end 138 of hose holder 135 is adapted to engage male end 127 of hose 125.

Referring back to accessory holder 40, illustrated in FIG. 2, when an appliance accessory, such as wand 115, is placed upon accessory holder 40, the female end 116 of wand 115 engages the base 45 of accessory holder 40 towards its second end 46. Likewise, if a user places the male end 117 of wand 115 on accessory holder 40, the smaller male end 117 engages the upper portion 41 of accessory holder 40 towards its second end 42.

Figure 3:
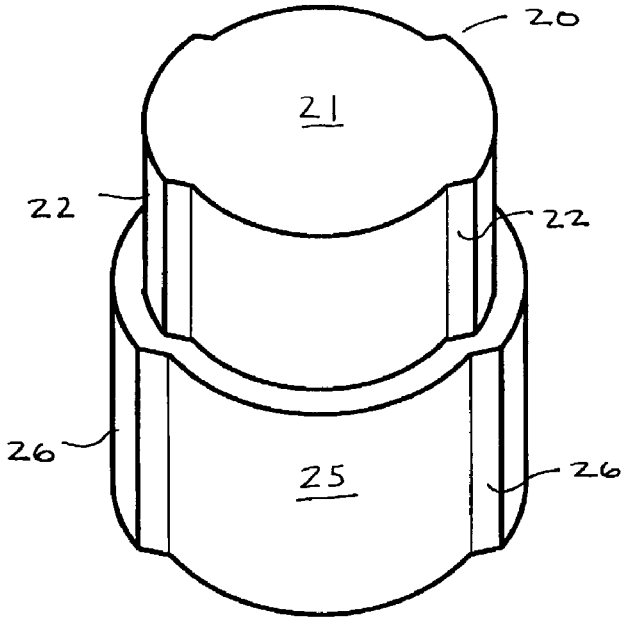
FIG. 3 illustrates a side view of another embodiment of an accessory holder of the present invention.
Figure 3A:
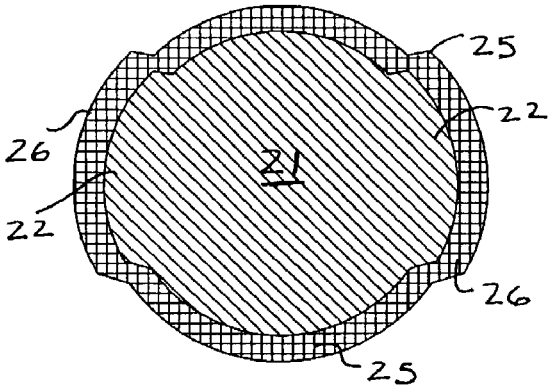
FIG. 3A shows a top view of the accessory holder shown in FIG. 3.

Another embodiment an accessory holder of the present invention, is illustrated in FIG. 3. FIG. 3 illustrates a side view of accessory holder 20, and a top view of accessory holder 20 is shown in FIG. 3A. As shown in FIG. 3, accessory holder 20 includes a body having a first member, such as base 25, and a second member, such as upper portion 21. The body can be constructed of any suitable material, such as polypropylene. Base 25 has dual surface first projections 26, and upper portion 21 has dual surface second projections 22. As shown in FIGS. 3 and 3A, the perimeter of base 25 is greater than the perimeter of upper portion 21. The body of accessory holder 20 is formed by placing upper portion 21 atop base portion 25, wherein first projections 26 and second projections 22 form the multi-stepped accessory holder 20. The upper portion's second projections 22 form an upper step, and the base's first projections 26 form a lower step.

Although the upper portion 21 and the base 25 has been described as two pieces, alternatively, the upper portion 21 and the base 25 can be an integral piece forming the body of accessory holder 20. Moreover, the body of accessory holder 20 can be integral with the portion of appliance 100 to which it is placed. For example, using any suitable process, such as injection molding, accessory holder 20 can be integral with the caster feet 104, can be integral with lid 102, and/or can be integral with caddy storage accessory 105 as shown in FIG. 1 and FIGS. 1A 1D.

Figure 7:
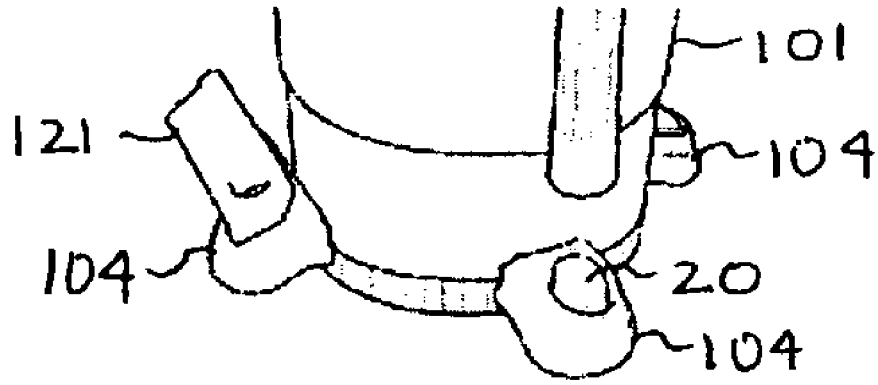
FIG. 7 illustrates the drum portion of the wet/dry vacuum shown in FIG. 1 having accessories attached to caster feet.
Figure 7A:
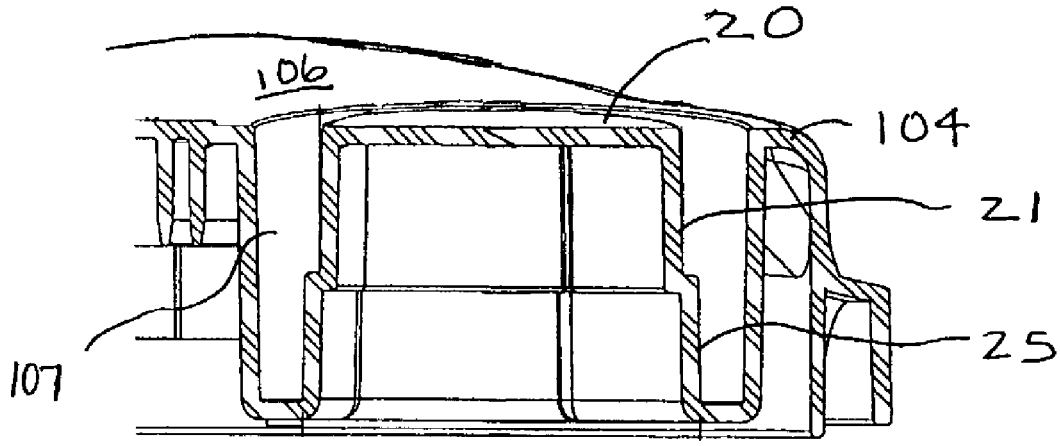
FIGS. 7A and 7B illustrate side cut-away views of the accessory holder shown FIG. 3, mounted within the caster feet.
Figure 7B:
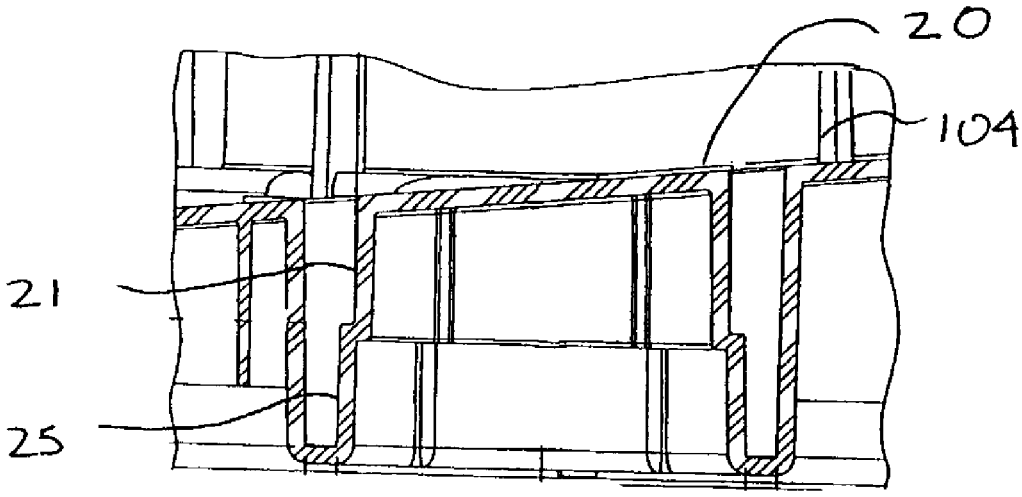

Turning to FIG. 7, a side view of drum 101 mounted onto caster feet 104 is shown. Arrows 126 of FIG. 7 depict wand 115 being placed onto accessory holder 20 within caster foot 104. FIG. 7 also shows a car tool accessory 121 mounted onto accessory holder 20 within caster foot 104. Referring to FIG. 7A, a side view cut-away of accessory holder 20 is shown mounted within and integral to caster foot 104. As illustrated in FIG. 7A, caster foot 104 forms an outer shell 106 around accessory holder 20. The outer shell 106 of caster foot 104 forms a wall 107 surrounding accessory holder 20. Referring to FIG. 7B, an alternative side view cut-away of accessory holder 20 is shown mounted within and integral to caster foot 104. In this embodiment shown in FIG. 7B, the top portion of upper portion 21 has a downward slope. This downward slope can be designed to assist in the removal and/or insertion of an accessory on accessory holder 20. For example, if the male end 137 of the hose holder 135 shown in FIG. 5 is mounted onto the upper portion 21 of the sloped accessory holder 20, the amount of the upper portion's surface contact with the hose holder 135 is reduced. Therefore, the frictional contact between the hose holder 135 and the upper portion's second projections 22 is also reduced making it easier to both insert and/or remove the hose holder 135 from the accessory holder 20. Moreover, when removing the hose holder 135 from the accessory holder 20, the user's rotation of the hose holder 135 toward the downward slope reduces the amount of force required to remove the hose holder 135 from the accessory holder 20. As previously mentioned, the top portion of upper portion 21 can also be mounted flush with the caster foot 104, lid 102, or caddy storage accessory 105.

Figure 9:
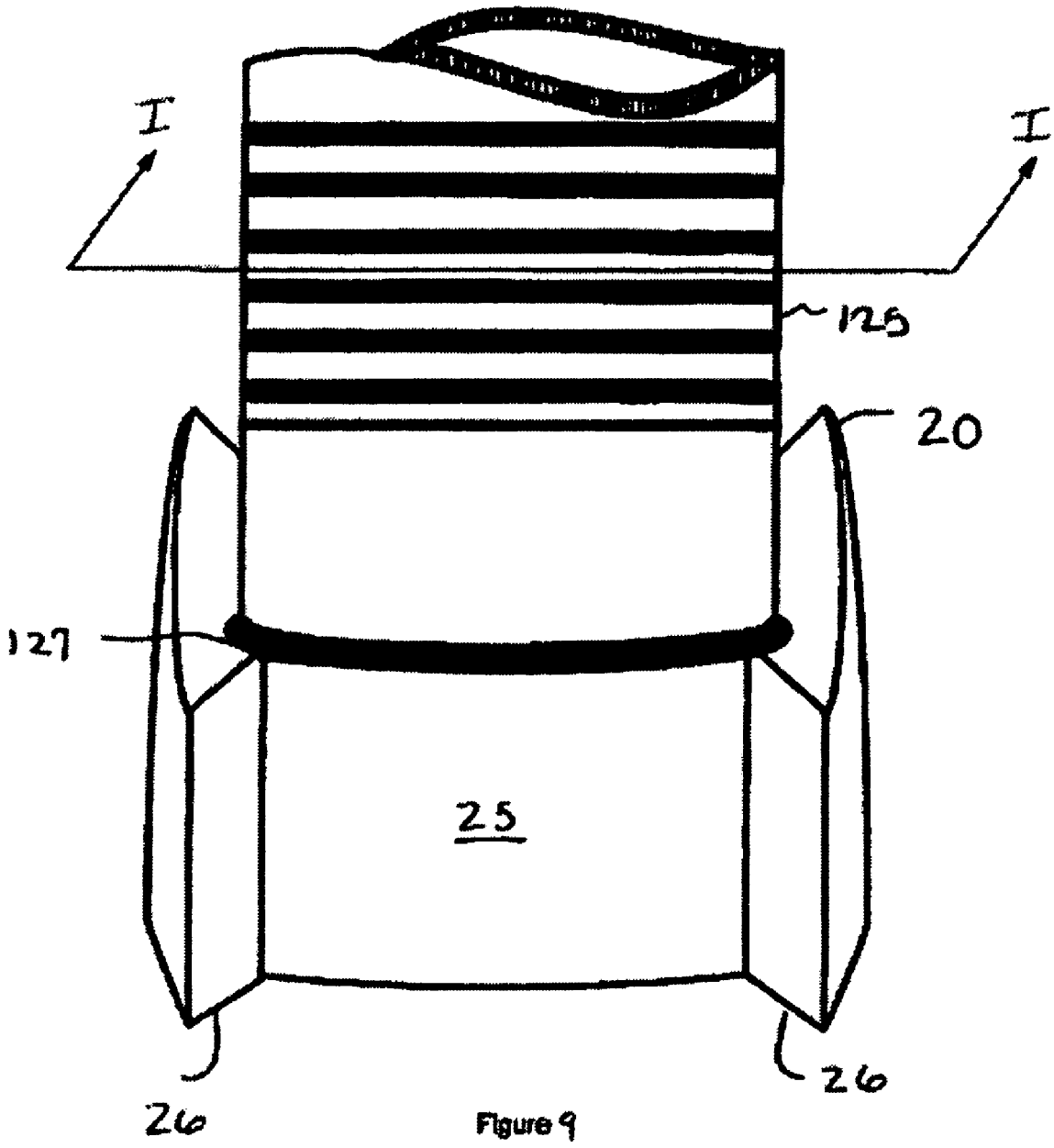
FIG. 9 illustrates the male end of the hose accessory shown in FIG. 6 mounted onto the accessory holder shown in FIG. 3.

Referring to FIG. 9, male end 127 of hose 125 is shown mounted onto accessory holder 20. Male end 127 of hose 125 engages dual surface second projections 22 of upper portion 21 of accessory holder 20. Because hose 125 fits over upper portion 21, the male inner diameter connection of hose 125 engaging dual surface second projections 22 is hidden. However, a sectional I-I top view of male end 127 of hose 125 mounted on accessory holder 20 is illustrated in FIGS. 10A and 10B.

Figure 10A:
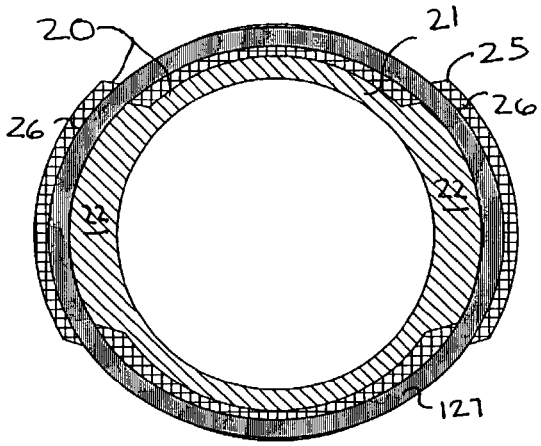
FIG. 10A is a top sectional I-I view of FIG. 9.

As illustrated in FIG. 10A, the inner diameter of the hose's male end 127 engages dual surface second projections 22 of upper portion 21. Because the outer perimeter of base 25 is larger than the outer perimeter of upper portion 21, male end 127 of hose 125 sets atop the step or shoulder formed by dual surface second projections 22 and dual surface first projections 26 as shown in FIGS. 9 and 10A. Because of the various tolerances of both accessory holder 20 and the accessory being held (e.g. wand 115, hose 125, and hose holder 135), when an accessory engages dual surface first projections 26 or dual surface second projections 22 some distortion of the accessory is possible. FIG. 10A shows some distortion of hose 125 when mounted on upper portion 21 of accessory holder 20.

Figure 10B:
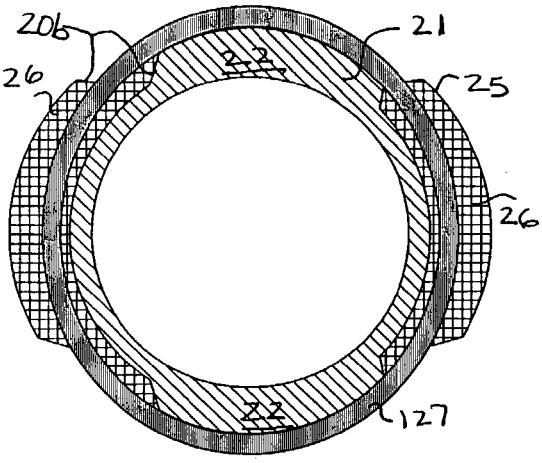
FIG. 10B is a top sectional view of an alternative design of the accessory holder shown in FIG. 3B.

Although accessory holder 20 is shown in FIGS. 3, 3A and 10A as having second projections 22 located directly above first projections 26, FIG. 10B illustrates an embodiment of the present invention having an alternative design accessory holder 20*b*, in which the second projections are perpendicular to the first projections. As shown in FIG. 10B, the upper portion 21 is rotated 90°, whereby upper portion 21 is perpendicular with base 25.

Figure 3B:
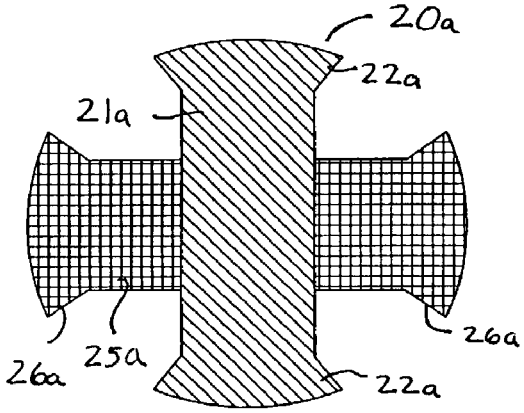
FIG. 3B shows an alternative design of an embodiment of an accessory holder of the present invention.
Figure 10C:
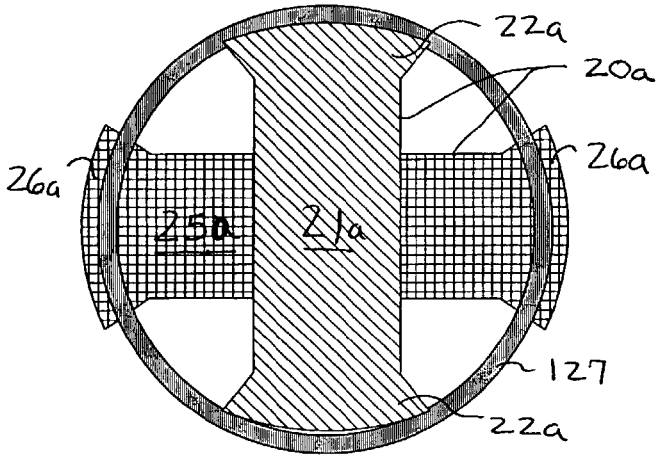
FIG. 10C is a top sectional view of the alternative design accessory holder shown in FIG. 3B having the hose accessory of FIG. 6 mounted to the accessory holder.

Any suitable configuration of the body of the accessory holder is considered within the scope of the present invention. Referring back to FIG. 3B, a top view of an alternative cross-shaped accessory holder 20*a* is shown. Cross-shaped accessory holder 20*a*, includes an upper portion 21*a* and a base 25*a*. Upper portion 21*a* has second projections 22*a* and base 25*a* has first projections 26*a*. FIG. 10C illustrates male end 127 of hose 125 engaging second projections 22*a* of upper portion 21*a*.

Figure 11:
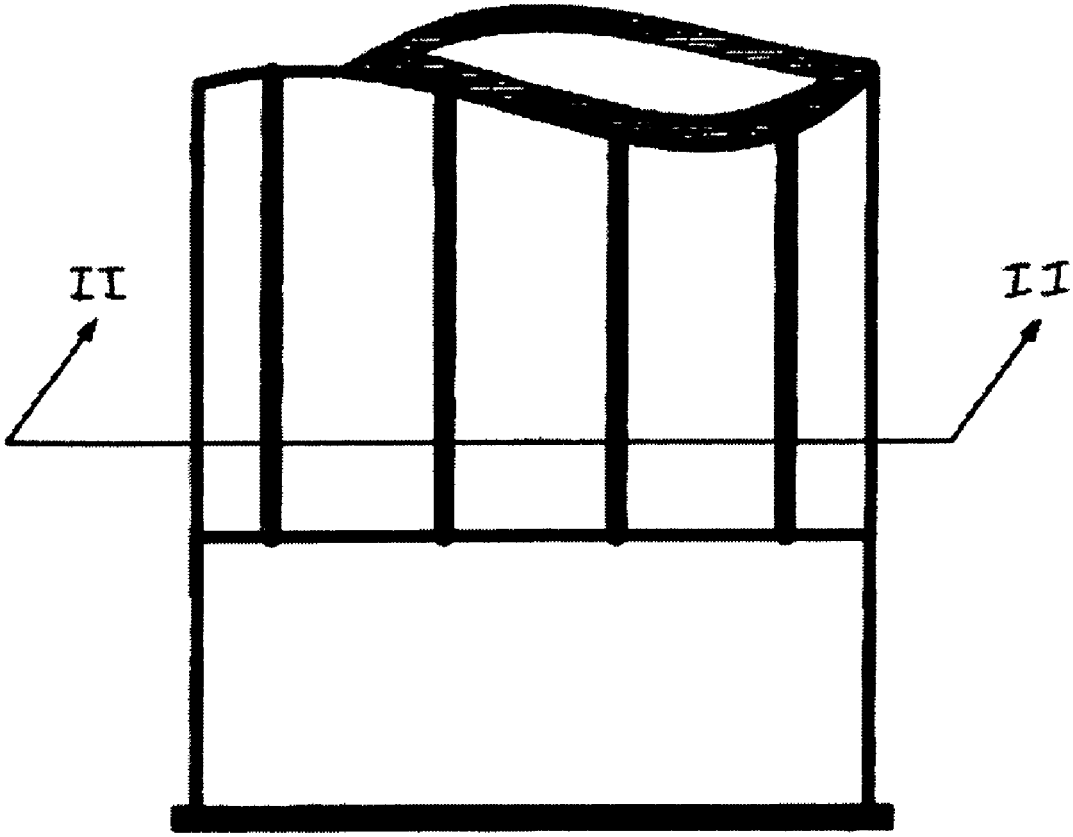
FIG. 11 illustrates the female end of the wand accessory shown in FIG. 4 mounted onto the accessory holder shown in FIG. 3.

When the female end of an accessory is placed on accessory holder 20, the female inner diameter connection engages first projections 26 of base 25. Referring to FIG. 11, wand 115 is shown surrounding the body of accessory holder 20. Because the wand 115 totally encloses accessory holder 20, the details of accessory holder 20 cannot be seen in FIG. 11. However, a sectional II-II top view of wand 115 engaging first projections 26 of base 25 is illustrated in FIG. 12A.

Figure 12A:
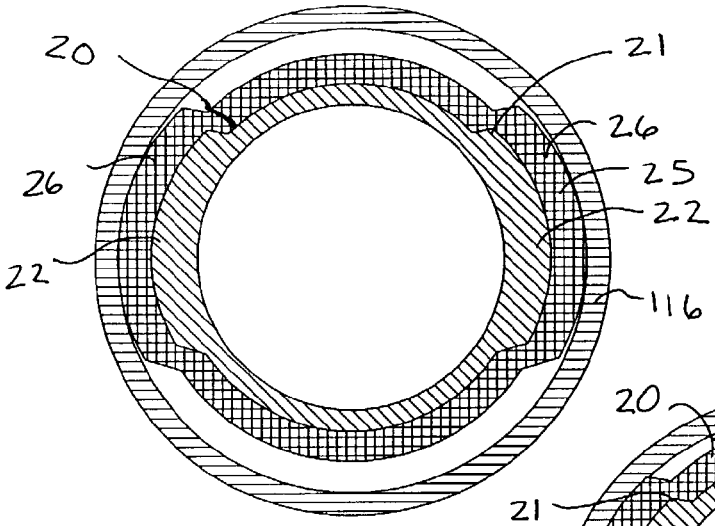
FIG. 12A is a top sectional II-II view of FIG. 11 showing minimal distortion of the wand accessory.
Figure 12B:
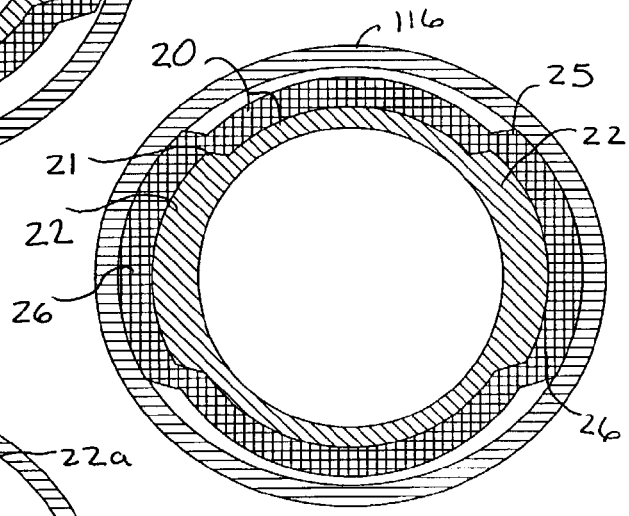
FIG. 12B is a top sectional II-II view of FIG. 11 showing substantial distortion of the wand accessory.
Figure 12C:
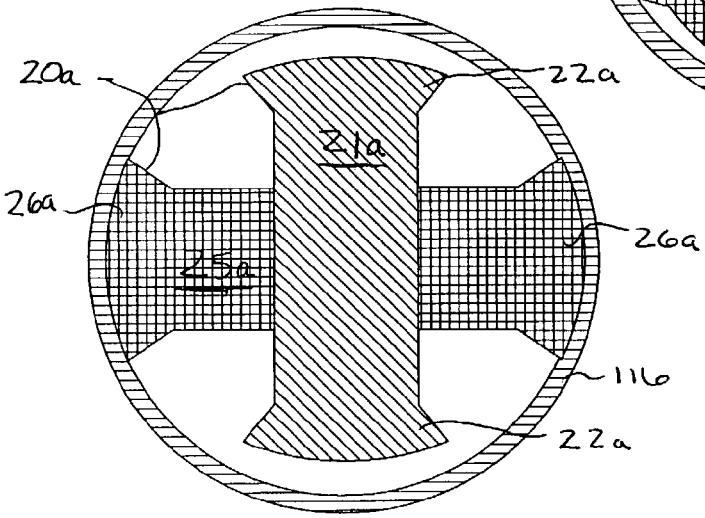
FIG. 12C is a top sectional view of the alternative design accessory holder shown in FIG. 3B having the wand accessory of FIG. 4 mounted to the accessory holder.

As shown in FIG. 12A the inner diameter of female end 116 of wand 115 engages first projections 26. FIG. 12A depicts the wand's female end 116 engaging first projections 26 without much distortion to the wand. However, because of the various tolerances of the both the accessory holder 20 and the wand 115 some distortion of the wand 115 can be expected as shown in FIG. 12B. Referring to FIG. 12C, the wand's female end 116 is shown engaging first projections 26*a* of the alternative cross-shaped accessory holder 20*a* shown in FIG. 3B.

First projections 26, 26*a* and second projections 22, 22*a* of accessory holder 20 are dual surface projections. The use of surface projections in various embodiments of the present invention reduces the variability of the insertion and removal force. This is accomplished by reducing the amount of frictional area in contact with the inner diameter of the accessory over conventional tapered fit accessory holders, and by allowing or forcing the accessories to distort slightly.

Although the various embodiments have been illustrated as having surface type first and second projections. Any suitable projections are considered within the scope of the invention, including those illustrated in FIGS. 13A 13F. For convenience purposes only top views of an upper portion of the body are shown. However, it can be appreciated that any projections of the base portion of the body can have similar designs as the upper portion, with the first projections of the base being oriented at any location relative to the upper portion.

Figure 13A:
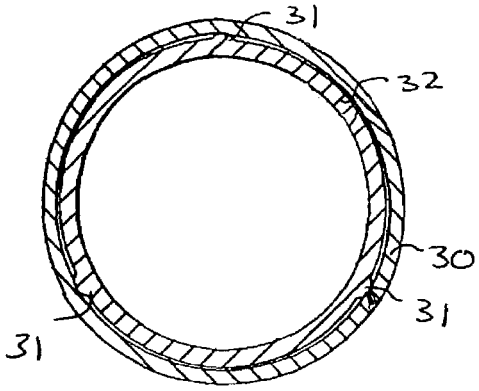
FIGS. 13A through 13F illustrate alternative projection styles and projection orientations for an embodiment of an accessory holder of the present invention.
Figure 13B:
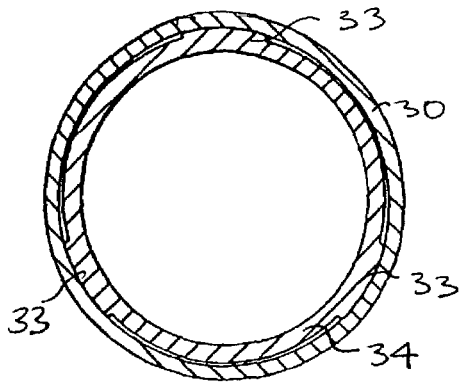
Figure 13C:
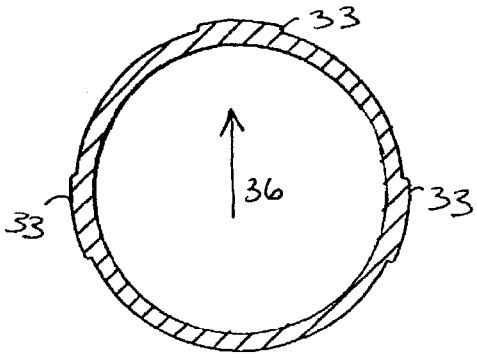
Figure 13D:
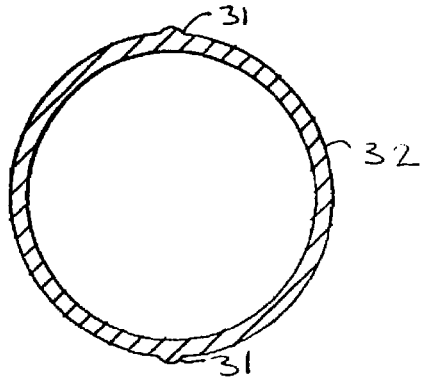
Figure 13E:
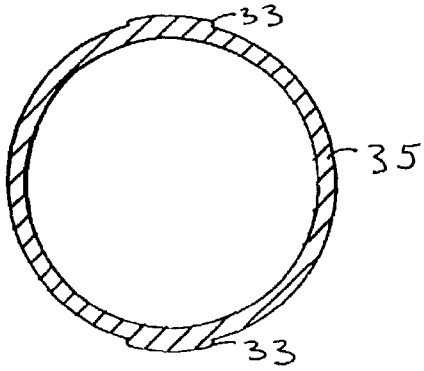

As shown in FIG. 13A, the male end of an accessory 30, such as hose 125 illustrated in FIG. 6, surround upper portion 32. Upper portion 32 has three lobe projections 31 that are engaged by the male end of accessory 30. Although FIG. 13A, illustrates the use of three lobe projections 31, any suitable number of lobe projections can be used, including the use of two lobe projections 31 as illustrated in FIG. 13D. Similar to the use of the three lobe projections 31 in FIG. 13A, FIG. 13B illustrates the male end of accessory 30 engaging three surface projections 33 of an alternative designed upper portion 34. In addition, FIG. 13E illustrates the use of two surface projections 33 of an alternative designed upper portion 35. The surface type projections 22, 26 and 33 previously illustrated and discussed in reference to FIGS. 3, 10A-10C, 12A 12C, 13B and 13E provide greater surface contact with an accessory and therefore reduce the stress on the accessory as opposed to lobe style projections 31 shown in FIGS. 13A and 13D.

Figure 13F:
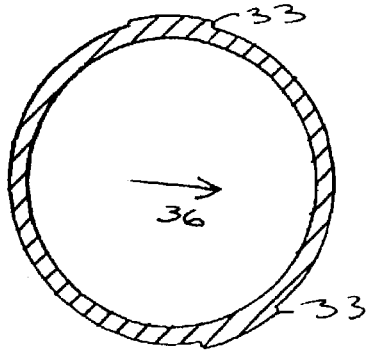

In reference to the location of lobe projections 31 and surface projections 33, the lobe projections 31 of FIGS. 13A and 13D, and the surface projections 33 of FIGS. 13B and 13E are equidistant. By equidistantly locating the lobe projections 31 or surface projections 33 the removal and insertion of the accessory on the accessory holder is non-directional. However, as shown in FIGS. 13C and 13F, surface projections 33 are not equally distanced apart, and are thus oriented at an offset. In this instance, the offset allows for easier removal of the accessory in the direction indicated by arrows 36. This offset geometry design makes the removal and/or insertion of the accessory directional. By controlling the orientation and/or distortion, insertion and/or removal of the accessory can be adjusted to make it easier or more difficult to engage and/or disengage the accessory in a controlled manner.

Figure 14:
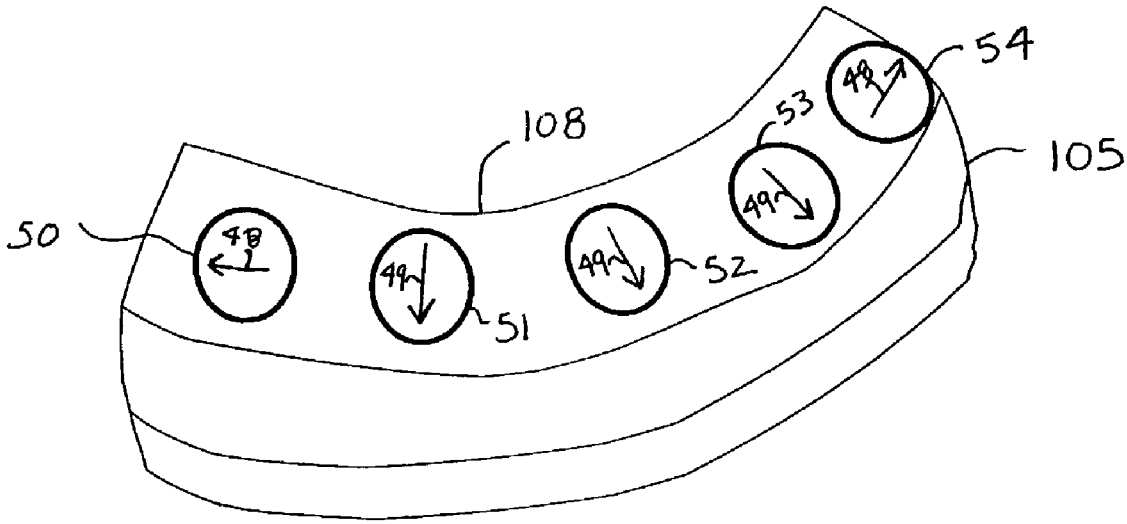
FIG. 14 illustrates an enlarged view of the caddy storage accessory illustrated in FIG. 8 having an embodiment of an accessory holder of the present invention mounted within the caddy storage accessory.

Moreover, in another aspect of an embodiment of the present invention, the holder is designed so that the projections are oriented and/or offset in a manner to make insertion and/or removal of an accessory easier in relation to the holder's location on the appliance and/or obstructions created by the location of other accessories or components of the appliance. For example, referring to FIG. 14, an enlarged view of caddy storage accessory 105 having arrows 48 and 49 is shown. Caddy storage accessory 105 is also illustrated in FIG. 1B, mounted to a wet/dry vacuum. The arrows 48 and 49 indicate the direction of easiest removal of an accessory that is created by offsetting the projections. As shown in FIG. 14, arrows 48 of accessory holders 50 and 54 indicate the easiest removal of an accessory in a direction away from adjacent accessory holders 51 and 53, respectively. Similarly, arrows 49 of accessory holders 51, 52, and 53 indicated the easiest removal of an accessory in a direction away from the interior rim 108 of caddy storage accessory 105. As depicted more clearly in FIG. 1B, the interior rim 108 (not shown) of caddy storage accessory 105 is adjacent the drum of a wet/dry vacuum. Hence, arrows 49 indicate that the projections of accessory holders 51, 52, and 53 are oriented at an offset so that an accessory is more easily removed in a direction away from the obstruction of the wet/dry vacuum drum. Orienting the multi-step offset geometry of the accessory holder toward specific design features of the vacuum, allows the designer to determine the direction of easiest or most difficult removal of the accessory from the holder.

Figure 15:
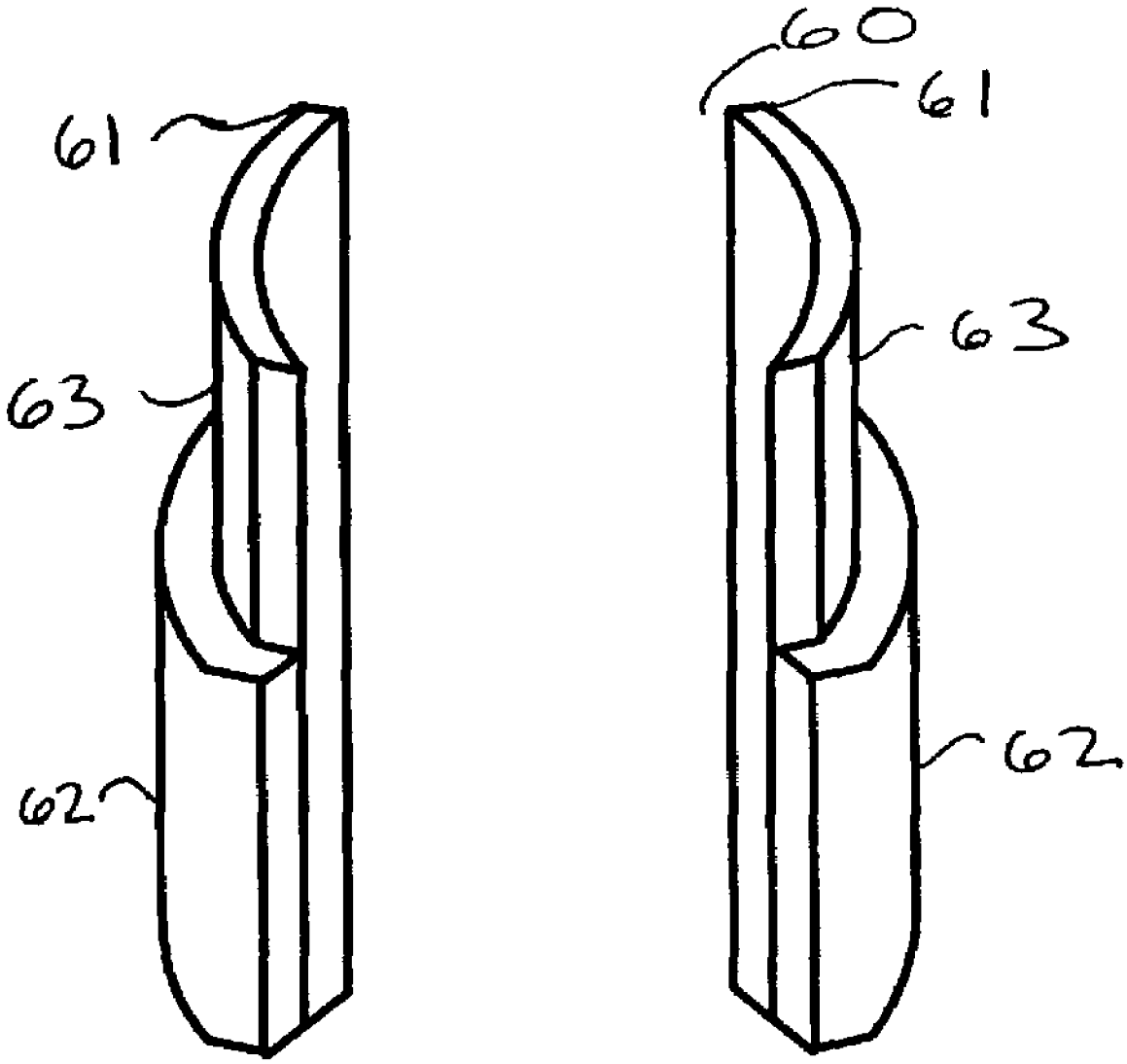
FIG. 15 illustrates a side view of an embodiment of an accessory holder of the present invention, the accessory holder having post members.

Turning to FIG. 15, an accessory holder 60 having an alternative embodiment of the present invention is shown. As shown in FIG. 15, accessory holder 60 has two post members 61. Each post member has a lower step 62 and an upper step 63. The post members 61 are sufficiently spaced apart in order to allow the lower steps 62 to engage a first inner diameter connection of an accessory, such as the female end 116 of wand 115 shown in FIG. 4; and to allow the upper steps 63 to engage a second inner diameter connection of an accessory, such as the male end 127 of hose 125 shown in FIG. 6. In this exemplary embodiment, the amount of material required to construct the holder is significantly reduced because the post members consume less surface area than accessory holder 40 illustrated in FIG. 2. Moreover, by positioning the post members so that the distance between the corners of the post members are not equal, the offset geometry design can still be achieved, making the removal and/or insertion of the accessory directional.

Although the previous exemplary embodiments of the present invention have been shown with two steps, other exemplary embodiments of the present invention include the accessory holder having additional steps to accommodate additional accessories having differing inner diameters, or even differing shapes.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the following claims or the equivalents thereof.

We claim:

1. A holder for holding accessories of an appliance, the accessories having a first inner diameter connection and/or a second inner diameter connection, the first inner diameter connection being larger than the second inner diameter connection, the holder comprising:

at least two post members, the post members each having a lower step and an upper step mounted atop the lower step;

a first perimeter formed by the lower step; and a second perimeter formed by the upper step, the first perimeter being larger than the second perimeter, the post members being positioned apart within the holder wherein when an accessory's first inner diameter connection is placed upon the holder, the first inner diameter connection engages the lower step of each post member, and when an accessory's second inner diameter connection is placed upon the holder, the second inner diameter connection engages the upper step of each post member.

2. The holder of claim 1, wherein the post members are positioned apart within the holder so that removal or insertion of the accessory is complemented in relation to the holder's location relative to the appliance, the accessories, or a component of the appliance.

3. A method for holding accessories of an appliance, the accessories having a first inner diameter connection and/or a second inner diameter connection, the first inner diameter connection being larger than the second inner diameter connection, the method comprising:

placing the first inner diameter connection on a first member, the first member having a first perimeter that is engaged by the first inner diameter connection; and placing the second inner diameter connection on a second member, the second member having a second perimeter that is engaged by the second inner diameter connection, wherein the first perimeter is larger than the second perimeter.

* * * * *